US008757442B2

(12) United States Patent
Holden

(10) Patent No.: US 8,757,442 B2
(45) Date of Patent: Jun. 24, 2014

(54) REVERSIBLE SPOUT FOR BOTTLES

(75) Inventor: William Holden, Durango, CO (US)

(73) Assignee: Holdenart, Inc., Durango, CO (US)

( * ) Notice: Subject to any disclaimer, the term of this patent is extended or adjusted under 35 U.S.C. 154(b) by 0 days.

(21) Appl. No.: 13/444,150

(22) Filed: Apr. 11, 2012

(65) Prior Publication Data

US 2013/0175294 A1 Jul. 11, 2013

Related U.S. Application Data

(60) Provisional application No. 61/585,094, filed on Jan. 10, 2012.

(51) Int. Cl.
*B67D 1/16* (2006.01)

(52) U.S. Cl.
USPC ..... 222/109; 222/546; 222/556; 222/492; 222/569; 222/491

(58) Field of Classification Search
CPC ..... B65D 47/063; B65D 48/0809; B65D 47/2031
USPC ..... 222/546, 556, 566, 569, 109, 111, 491, 222/492, 526, 527–530
See application file for complete search history.

(56) References Cited

U.S. PATENT DOCUMENTS

| | | | | |
|---|---|---|---|---|
| 2,743,852 | A | 5/1956 | Alberdi, Jr. | |
| 3,279,643 | A | 10/1966 | Amesbury et al. | |
| 4,941,580 | A | 7/1990 | Julian | |
| 5,377,877 | A | 1/1995 | Brown et al. | |
| 5,390,805 | A | 2/1995 | Bilani et al. | |
| 5,531,363 | A | 7/1996 | Gross et al. | |
| 5,971,232 | A | 10/1999 | Rohr et al. | |
| 6,089,411 | A | 7/2000 | Baudin et al. | |
| 6,293,437 | B1 * | 9/2001 | Socier et al. | 222/212 |
| 6,446,844 | B1 | 9/2002 | Gross | |
| 6,530,504 | B2 | 3/2003 | Socier | |
| 6,616,016 | B2 | 9/2003 | Hicks et al. | |
| 6,749,089 | B2 * | 6/2004 | Stull et al. | 222/108 |
| 6,769,577 | B1 * | 8/2004 | Feierabend | 222/491 |
| 7,152,763 | B2 | 12/2006 | Stull et al. | |
| 7,299,952 | B2 | 11/2007 | Stull et al. | |
| 7,306,128 | B2 | 12/2007 | Eimer | |
| 7,448,556 | B2 * | 11/2008 | Muehlhausen et al. | 239/306 |
| 7,503,469 | B2 | 3/2009 | Bloom et al. | |
| 7,628,297 | B2 | 12/2009 | Pugne | |
| 7,681,750 | B2 | 3/2010 | Jackel | |
| 7,699,193 | B2 | 4/2010 | Feierabend | |

(Continued)

*Primary Examiner* — Paul R Durand
*Assistant Examiner* — Jeremy W Carroll
(74) *Attorney, Agent, or Firm* — Marsh Fischmann & Breyfogle LLP

(57) ABSTRACT

A spout for use with a container for dispensing a substance (e.g., a condiment) from the container such that any remaining substance exterior to the container adjacent the spout may be allowed to drain back into the container. A lid may be engaged with a container at an engagement portion. A spout portion of the lid that is positionable between a dispensing position and a storage position may define an orifice. The orifice may provide for communication between an interior volume of the container and an exterior of the container. Thus, the substance may be dispensed through the orifice. Furthermore, when in the storage position, the spout portion may direct any remaining substance on an exterior portion of the spout portion through the orifice and back into the container. Thus, a cleaner and more sanitary top of the container may be realized.

18 Claims, 11 Drawing Sheets

(56) References Cited

U.S. PATENT DOCUMENTS

| | | | | |
|---|---|---|---|---|
| 7,784,652 | B2 | 8/2010 | Gaus et al. | |
| 7,842,215 | B2 | 11/2010 | Eimer | |
| 2002/0125272 | A1 | 9/2002 | Sekendur | |
| 2002/0134801 | A1 | 9/2002 | Stewart | |
| 2003/0057237 | A1 | 3/2003 | Stull et al. | |
| 2004/0040987 | A1 | 3/2004 | Ramsey et al. | |
| 2007/0075030 | A1* | 4/2007 | Delli Venneri | 215/235 |
| 2007/0077655 | A1* | 4/2007 | Unger et al. | 435/404 |
| 2007/0278255 | A1* | 12/2007 | Pantelleria | 222/529 |
| 2010/0038380 | A1* | 2/2010 | Compton | 222/105 |
| 2010/0038386 | A1* | 2/2010 | Pritchard | 222/522 |
| 2010/0147900 | A1 | 6/2010 | Tardif | |
| 2010/0294812 | A1* | 11/2010 | Lohrman et al. | 222/541.9 |
| 2011/0248045 | A1* | 10/2011 | Harris et al. | 222/94 |

* cited by examiner

REVERSIBLE SPOUT FOR BOTTLES

CROSS REFERENCE TO RELATED APPLICATIONS

This application claims the benefit of U.S. Provisional Application No. 61/585,094, filed on Jan. 10, 2012, and entitled "REVERSIBLE SPOUT TOP FOR BOTTLES", which is incorporated by reference herein in its entirety.

FIELD

The present disclosure generally relates to lids that are engageable with an opening of a container to direct the flow of material from the container, and specifically to lids with a positionable spout that may facilitate the return of material to the interior of the container.

BACKGROUND

Condiments (e.g., ketchup, mustard, mayonnaise, salad dressing, etc.) are often provided in a container adapted to dispense the condiment directly from the container. Traditionally, the container may contain a necked portion leading to an opening through which the condiment may be dispensed. In this regard, the necked portion may assist in controlling the flow of the condiment from the container. However, oftentimes it is difficult to initiate flow of the condiment from the container or to control the flow from the container once initiated.

In this regard, containers that are compressible or squeezable have been proposed. The squeezable containers may provide some obstruction in the opening of the container that significantly limits the flow of condiments from the bottle. To overcome this, the body of the container may be compressible or flexible such that the container may be squeezed to expel condiments from the opening. As the force exerted on the container body may be controlled, the amount of condiment expelled may be correspondingly controlled.

However, such squeezable containers often become messy when excess material is dispensed from the opening (e.g., as the user stops squeezing the container to stop the flow of the condiment from the container). In this regard, excess material may remain adjacent to the opening of the container on the exterior of the container or within the opening. Oftentimes such containers are provided with lids or closures that are used to close the opening of the container. The closures can also become soiled with excess material such that the opening of the container becomes messy, unsanitary, or, in some cases, blocked all together. This presents an unsightly, off-putting appearance of the bottle, can limit the effectiveness of the container to dispense the condiment, and can lead to the condiment coming in contact with the hands of the user or creating a mess where the container is stored. Furthermore, in the case where the opening is obstructed, excess force may be required to expel the buildup of condiment from the opening resulting in product waste or further spillage of the condiment as a large amount of condiment may be expelled as a result.

SUMMARY

In this regard, the present disclosure includes spouts and/or lids including structures engageable with the opening of a container and/or structures provided adjacent to the opening of the container for containers (e.g., bottles or the like) that may address at least some of the foregoing deficiencies identified with respect to prior containers. Accordingly, cost effective and user friendly lids are provided that may reduce the buildup of material adjacent an opening of the container (e.g., adjacent to the spout) while still allowing for control of the flow of a substance from the container. Accordingly, the opening of the container may remain more sanitary. Furthermore, the lids disclosed herein are easy to operate without adding excess cost or complexity to the container. The lids described herein may be used with a variety of containers having different opening configurations. In this regard, the lids described herein may be used with a variety of products including, for example, condiments as described above; personal care product such as lotions, gels, soaps, etc.; industrial fluids such as oil, hydraulic fluid, automotive fluids, etc.; or other substances that are advantageously dispensed in a controlled manner without creating a build-up of the substance adjacent the opening of the container.

Accordingly, a first aspect disclosed herein includes a lid for a container that is operable to contain a condiment in an interior volume thereof such that the condiment is dispensable from the container. The lid further includes an engagement portion operatively engageable with the container adjacent to an opening of the container. The lid also includes a spout portion extending from the engagement portion and covering at least a portion of the opening. The spout portion defines an orifice though which the condiment may be communicated, wherein the spout portion is positionable between a dispensing position and a storage position. When in the storage position, the spout portion directs any of the condiment on an exterior portion of the spout portion through the orifice and into the container.

A second aspect disclosed herein includes a container for retaining and dispensing a condiment. The container includes a sidewall defining an interior volume for containing the condiment. The container further includes an opening between the interior volume and an exterior of the condiment. The container also has a spout portion engaged with the opening and covering at least a portion of the opening. The spout portion has an inner face and outer face, the inner face being disposed nearer the interior volume than the outer face. Furthermore, the spout portion defines an orifice through which the substance may be communicated. The spout portion is positionable between a dispensing position and a storage position. Accordingly, when in the storage position, the spout portion is operable to direct any condiment remaining on the outer face through the orifice and into the interior volume.

A number of feature refinements and additional features are applicable to the first and/or second aspects. These feature refinements and additional features may be used individually or in any combination. As such, each of the following features that will be discussed may be, but are not required to be, used with any other feature or combination of features of the first and/or second aspect.

For example, the condiment may be dispensable through the orifice when the spout portion is in the dispensing position. Additionally, the engagement portion may extend about a periphery of the opening. For instance, the spout portion may extend radially from the engagement portion. As such, the orifice may be defined by an edge in concentric offset relation from the engagement portion.

The spout portion may include an inner face and an outer face. The inner face may be on a side of the spout portion nearer the inner volume than the outer face. Accordingly, when in the storage position, the outer face may define a sloping surface for directing any remaining substance on the exterior portion of the spout portion through the orifice and into the container. In an embodiment, when in the storage position, the outer face may be disposed relative to gravity to direct flow of any of the substance on an exterior portion of the spout portion through the orifice and into the container.

In another embodiment, at least a portion of the spout portion may extend from a plane corresponding to an upper surface of the engagement portion. For instance, the spout portion may extend from the plane by a distance of no less than about 2 mm and no more than about 15 mm when the spout portion in is the storage position. Additionally, at least a portion of the spout portion may be at a first angle relative to the plane corresponding to the upper surface of the engagement portion when the spout portion is in the storage position. The first angle may be no less than about 20 degrees and no more than about 80 degrees. Further still, at least a portion of the spout portion may be at a second angle relative to the plane corresponding to the upper surface of the engagement portion when the spout portion is in the dispensing position. The second angle may be no less than about 20 degrees and no more than about 80 degrees.

In one embodiment, the spout portion may be selectively positionable between the dispensing position and engagement position by a user. In this regard, the lid may further include a cap selectively engageable with respect to the opening of the container to sealingly close the opening. The cap may include a projection operatively engageable with the spout portion to dispose the spout portion between the dispensing position and the storage position. The projection may be correspondingly sized with the orifice to contactably engage the edge of the orifice. The projection may urge the spout portion to the storage position when the cap is attachably engaged with respect to the opening and the projection urges the spout portion to the dispensing position when the cap is removably disengaged with respect to the opening.

In another embodiment, the lid may include a tab connectedly engaged with the spout portion. The tab may be manipulateable to position the spout portion between the dispensing position and the storage position.

In still another embodiment, the lid portion may be biased to the storage position and may be deflectable to the dispending position when the substance is dispensed from the container (e.g., by the force of the substance acting on the spout portion during the dispensing positions the spout portion in the dispensing position).

In one embodiment, the orifice may be no less than about 0.2 cm and no more than about 1.5 cm in diameter. Furthermore, the orifice may be no less than about 6% and no more than about 40% of the area of the opening of the container. The spout portion may extend for a distance of no less than about 0.2 cm and no more than about 7.8 cm from the engagement portion to an edge defining the orifice. In one embodiment, the thickness of the spout portion may be constant. For example, the thickness of the spout portion may be no less than about 0.5 mm and no more than about 10 mm.

In one embodiment, when in the storage position, at least a portion of the spout portion may project from the engagement portion into the interior volume of the container.

A third aspect described herein includes a method for use with a container operable to dispense a substance. The method includes positioning a spout portion adjacent to an opening of the container into a dispensing position and dispensing the substance from the container through an orifice defined by the spout portion. The method further includes disposing the spout portion into a storage position and directing any remaining substance on an exterior of the spout portion through the orifice and into the container when the spout portion is in the storage position. In one embodiment, the spout portion may include an inclined portion relative to gravity for directing any remaining substance on the exterior of the spout portion through the orifice and into the container.

DETAILED DESCRIPTION

The following description is not intended to limit the invention to the form disclosed herein. Consequently, variations and modifications commiserate with the following teachings, skill, and other knowledge of the relevant art, are within the scope of the present invention. The embodiments described herein are further intended to explain modes known of practicing the invention and to enable others skilled in the art to utilize the invention in such, or other embodiments, and with various modifications required by the particular application (s) or use(s) of the invention.

The present disclosure generally relates to lids, closures, covers, or similar structures that can be used with a container to dispense a substance from the container. The lids disclosed herein may be used in conjunction with any number of different types of containers and substances. For example, one particularly advantageous application of the lids disclosed herein may be for containers of edible condiments. While the following disclosure may refer to the dispensed substance as a condiment, it will be understood that the lids described herein may be used in contexts other than condiments such as, for example, with containers to dispense industrial fluids, personal care products, etc. Furthermore, while described primarily herein as structures that may be selectively engaged with an opening of a container (e.g., by way of a screw top or the like), it will be further understood that some or all of the lid may be provided integrally with a container.

For example, a condiment (e.g., ketchup, mustard, mayonnaise, salad dressing, etc.) may be dispensed from a container such that the condiment passes through an orifice of the lid provided with respect to an opening of the container. The orifice may be provided in a spout portion of the lid that is positionable between a dispensing position and a storage position (e.g., in response to the dispensing of the condiment or selectively by a user). In one embodiment, the spout portion may be reversible between the dispensing position and storage position. The lids described herein may facilitate dispensing of the condiment and provide features that allow any remaining condiment on an exterior of the lid to drain back into the container when a spout of the lid is in the storage position. For example, the remaining condiment may drain back into the container through the orifice through which the condiment was dispensed.

Figure 1A:
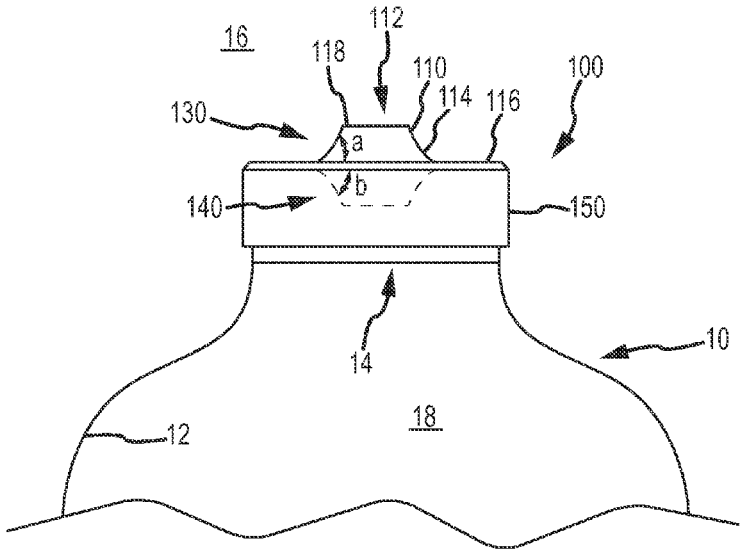
FIG. 1A depicts an embodiment of a lid having a spout portion that is positionable between a dispensing position and a storage position (shown in phantom).

FIG. 1A shows an embodiment of a lid 100. The lid 100 may include an engagement portion 150 that is operable to engage a container 10 (e.g., a bottle) as will be described in greater detail below. The lid 100 may further include a spout portion 110 that, as shown, is positionable between a dispensing position 130 and a storage position 140 (the spout portion 110 being shown in phantom lines in the storage position 140). The positioning of the spout portion 110 may be in response to the action of a condiment on the spout portion 110 as the condiment is being dispensed, or the spout portion 110 may be selectively positioned between the dispensing position 130 and the storage position 140 by a user. In this regard, the spout portion 110 may be reversibly positioned between the dispensing position 130 and the storage position 140.

In one embodiment, the spout portion 110 and the engagement portion 150 may comprise different materials. For example, the spout portion 110 may be over-molded with the engagement portion 150. In still another embodiment, the spout portion 110 may be secured to the engagement portion 150 by ultrasonic welding, adhesives, an interference fit, a snap-fit, or any other means known in the art. In another embodiment, the engagement portion 150 may be integral with the spout portion 110 (i.e., constructed from the same material).

In any regard, the spout portion 110 may define an orifice 112. The orifice 112 may allow for communication between an exterior 16 of the container 10 and an interior volume 18 of the container 10. The orifice 112 may remain open when the spout portion 110 is in the dispensing position 130 and the storage position 140. In this regard, the condiment, for example, contained in the interior volume 18 of the container 10 may be dispensed from the container 10 through the orifice 112 when the spout portion 110 is in the dispensing position 130. At least a portion of the spout portion 110 may extend over or cover the opening 14 of the container 10. That is, the spout portion 110 may define a flow limiting or controlling member (e.g., a nozzle) to direct the flow of the condiment as it exits the interior volume 18 of the container 10. In this regard, the interior face of the spout portion 110 may define a sloped surface when in the dispensing position 130 to assist in directing the condiment from the container 10 through the orifice 112.

It will be appreciated that in some instances, when the condiment is dispensed from the container 10, some of the condiment may remain adjacent to the exterior of the opening 14 (e.g., on an exterior face 114 of the spout portion 110). For example, as the flow of the condiment from the container 10 is terminated, some amount of excess condiment may be expelled through the orifice 112 that comes to rest on the exterior face 114 of the lid 100. In traditional lids, the excess condiment remaining after dispensing may build up and become messy, or worse, unsanitary. Furthermore, should the container be sealed with a cap or closure, the excess substance may interfere with the engagement of the cap and the container, may get on a user's hands as the user attempts to remove the cap to use the container 10, or may block the opening through which the condiment is dispensed.

Accordingly, the spout portion 110 as described herein may be positioned in the storage position 140 (shown in phantom lines in FIG. 1) such that any condiment remaining on the exterior (e.g. the exterior face 114) of the lid 100 may drain back into the interior volume 18. It will be appreciated that when in the storage position 140, at least a portion of the spout portion 110 may define an inclined surface extending from an upper surface 116 the engagement portion 150 to the orifice 112. The inclined surface may direct any excess condiment remaining on the exterior face 114 of the spout portion 110 toward the orifice 112 such that the excess condiment is allowed to drain back into the interior volume 18 of the container 10 through the orifice 112. For example, the container 10 may normally rest such that the upper surface 116 is generally higher than the orifice 112 with respect to gravity when the spout portion 110 is in the storage position 140. As such, when the spout portion 110 is disposed in the storage position 140, any condiment remaining on the exterior face 114 of the spout portion 110 may drain back into the interior volume 18 by way of gravity.

Figure 1B:
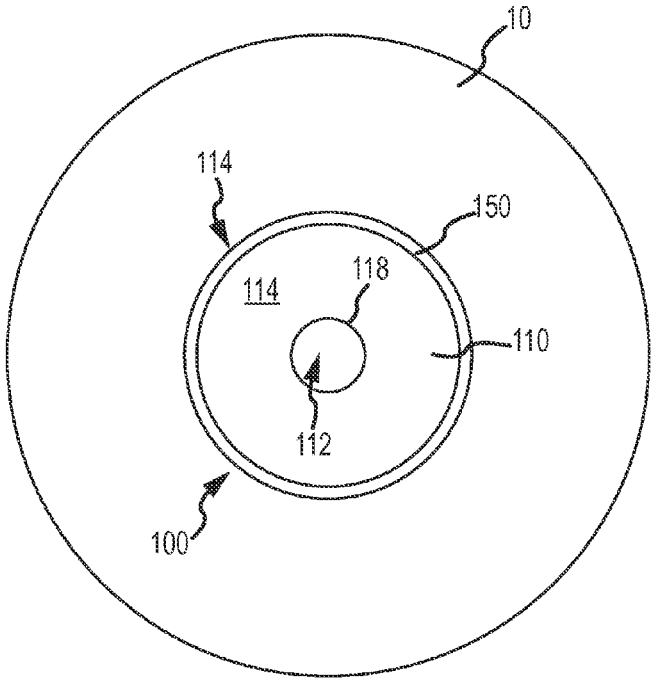
FIG. 1B is a top view of the embodiment shown in FIG. 1A.

With further reference to FIG. 1B, the spout portion 110 may extend from the engagement portion 150 to an edge 118 defining the orifice 112. For example, the spout portion 110 may extend radially inwardly from the engagement portion 150 to cover at least a portion of the opening 14 of the container 10. In this regard, the orifice 112 may be defined by the edge 118. In one embodiment, the edge 118 may be in concentric offset relation from the engagement portion 150. In one embodiment, the orifice 112 may be about 0.6 cm in diameter. In another embodiment, the orifice 112 may be no smaller than about 0.2 cm and no larger than about 1.5 cm in diameter. In another embodiment, the engagement portion 150 may be about 3.5 cm in diameter. In another embodiment, the engagement portion 150 may be no smaller than about 1 cm and no larger than about 8 cm in diameter. Furthermore, the orifice 112 may comprise an area that is about 6% of the area of the opening 14 of the container 10 to which the lid 100 is attached. In another embodiment, the orifice 112 may include an area that is no less than about 2% and no more than about 40% of the area of the opening 14 of the container. In one embodiment, the spout portion 110 extends radially from the engagement portion 150 a distance of about 3 cm. In another embodiment, the spout portion 110 may extend from the engagement portion 150 a distance no smaller than about 0.2 cm and no larger than about 7.8 cm. In this regard, the orifice 112 may be generally circular.

In another embodiment, an orifice may be provided with a non-circular shape. For example, an orifice may be provided generally that is an oval, an elongated slot, a triangle, or other appropriate shape. Furthermore, in an embodiment, the orifice may be non-concentric with respect to the engagement portion. In this regard, in different embodiments the orifice may be located at different relative locations on the spout portion (e.g., nearer one portion of the engagement portion than another portion of the engagement portion).

As can be appreciated in FIG. 1A, the spout portion 110 may be positioned between the dispensing position 130 and the storage position 140. In this regard, the spout portion 110 may be constructed from a flexible material such as, for example, silicone, soft plastic, or rubber. Accordingly, the spout portion 110 may be deflectable (e.g., reversible) between the dispensing position 130 and the storage position 140. In one embodiment, the deflection of the spout portion 110 between the dispensing position 130 and the storage position 140 may be in response to a user's selective positioning of the spout portion 110. That is, absent a user imparting a force on the spout portion 110 to change the position of the spout portion 110, the spout portion 110 may remain in position (e.g., in either the dispensing position 130 or the storage position 140). Different potential embodiments for selectively positioning the spout portion 110 between the dispensing position 130 and the storage position 140 will be discussed in greater detail below.

In another embodiment, the spout portion 110 may be biased to the storage position 140 such that absent application of any external force, the spout portion 110 may be urged to the storage position 140 by way of, for example, an internal spring force of the spout portion 110. The spout portion 110 may be deflected to the dispensing position 130 by the application of a force tending to cause the spout portion 110 to bulge outwardly. For example, upon creation of relatively higher pressure in the interior volume 18 of the container than an exterior 16 of the container (e.g., to dispense a condiment by squeezing the sidewall 12 of the container 10 to expel the condiment from the container 10), the spout portion 110 may be deflected from the storage position 140 to the dispensing position 130. Upon release of the pressure associated with dispensing the condiment, the spout portion 110 may deflect back to the storage position 140 under the influence of the biasing force of the internal spring force of the spout portion 110.

In this regard, it will be appreciated that the spout portion 110 may project away from a plane corresponding to an upper surface 116 of the engagement member 150. For example, when the spout portion 110 is in the dispensing position 130, at least a portion of the spout portion 110 may project away from the upper surface 116 of the engagement member 150 in a direction toward the exterior 16 of the container 10 by a distance of about 6 mm. In another embodiment, the spout portion 110 may project away from the upper surface 116 of the engagement member 150 toward the exterior 16 of the container 10 by a distance no smaller than about 2 mm and no larger than about 15 mm. Furthermore, when the spout portion 110 is in the storage position 140, at least a portion of the spout portion 110 may project away from the upper surface 116 of the engagement member 150 in a direction toward the interior volume 18 of the container 10 by a distance of about 6 mm. In another embodiment, the spout portion 110 may project away from the upper surface 116 of the engagement member 150 in a direction toward the interior volume 18 of the container 10 by a distance no smaller than about 2 mm and no larger than about 15 mm. It will be appreciated that the spout portion 110 may project the same distance from the upper surface 116 in the dispending position 130 toward the exterior 16 of the container 10 as the spout portion 110 projects from the upper surface 116 in the storage position 140 in a direction toward the interior 18 of the container 10. In another embodiment, the distance the spout portion 110 projects form the upper surface 116 when in the dispensing position 130 may be different when in the dispensing position 130 and the storage position 140. In yet another embodiment, the spout portion 110 may project from the upper surface 116 a different distance at different portion of the edge 118 defining the orifice 112. That is, a portion of the edge 118 of the orifice 112 may extend further from the upper surface 116 than another portion of the edge 118. This may provide a pour-spout shape (e.g., for helping to direct a relatively low viscosity condiment from the container 10) when the spout portion 110 is in the dispensing position 130.

Furthermore, it will be appreciated that the spout portion 110 may form an angle a between a plane corresponding to the upper surface 116 when in the dispensing position 130 and an angle b between the plane corresponding to the upper surface 116 when in the storage position 140. The angle a and angle b may be the same or may be different. In one embodiment, the angles a and/or b may be about 45 degrees. In another embodiment, the angles a and/or b may be no less than about 20 degrees and no more than about 80 degrees. Furthermore, it will be appreciated that the portion of the spout portion 110 that deflects between the dispensing position 130 and the storage position 140 may not form a linear surface (e.g., as will be further discussed below with reference to FIGS. 10A and 10B). In this regard, the foregoing angle measurements may be measured as an approximation of the angle between the orifice edge 118 and the plane corresponding to the upper surface 116 even if the spout portion 110 actually extends away from the upper surface 116 in a parabolic or other fashion. For example, the spout portion 110 may include a radius of curvature when in the dispensing position 130 and/or the storage position 140 of no less than about 2 mm and no more than about 40 mm.

The spout portion 110 may have a constant thickness. For example, in one embodiment, the thickness of the spout portion 110 may be about 1 mm. In another embodiment, the thickness of the spout portion 110 may be no less than about 0.5 mm and no more than about 4 mm. Alternatively, the spout portion 110 may have a variable thickness, wherein the thickness of the spout portion 110 varies between the portion adjacent to the engagement portion 150 and the orifice edge 118. For example, the spout portion may reduce in thickness closer to the orifice edge 118. In one embodiment, the spout portion 110 may be no less than about 0.5 mm thick to no more than about 3 mm thick adjacent to the engagement portion 150 and from no less than about 0.5 mm thick to no more than about 3 mm thick adjacent to the orifice edge 118. Furthermore, the thickness of the spout portion 110 may be different from the thickness of the engagement portion 150. In another embodiment, the thickness of the spout portion 110 may be the same as the thickness of the engagement portion 150.

Figure 2B:
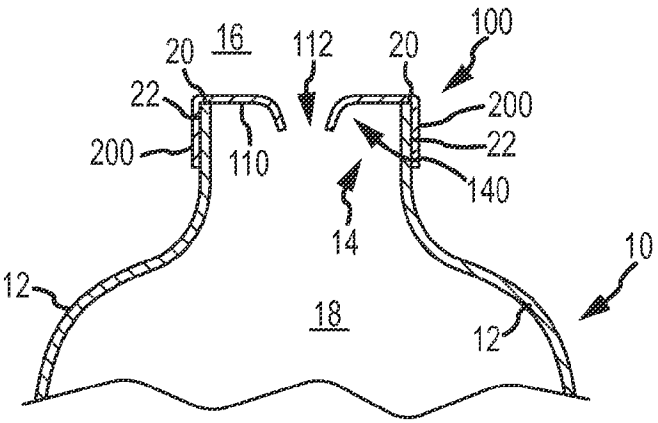
FIGS. 2A-2B depict cross sections of another embodiment of a lid having a spout portion in a dispensing position and a storage position, respectively.
Figure 2A:
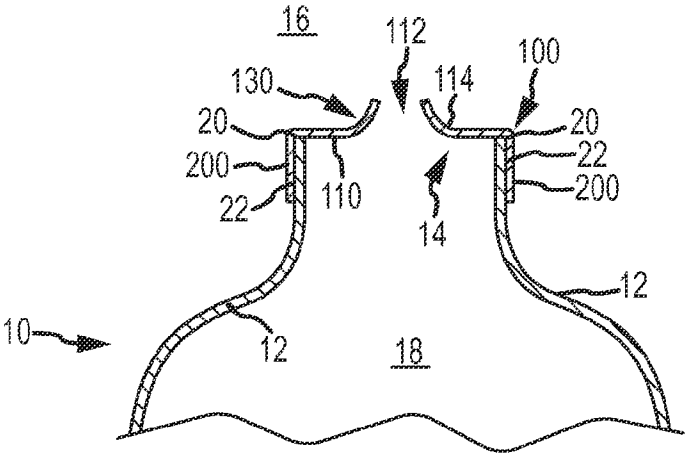

FIG. 2A depicts a lid 100 having one embodiment of an engagement portion 200. The engagement portion 200 may be configured to engage an outer portion 22 of a terminal end portion 20 of a sidewall 12 of the container 10. In this regard, the engagement portion 200 may include, for example, a threaded interface that engages a correspondingly threaded interface of the outer portion 22 of the sidewall 12 adjacent to the container opening 14 to retainably engage the spout portion 110 with respect to the container opening 14. For example, male threads may be provided on the outer portion 22 and corresponding female threads may be provided on the engagement portion 200. Other connection mechanisms may be employed to secure the engagement portion 200 to the outer portion 22 of the container 10 such as, for example, an interference fit, a snap-fit, coordinating tabs, etc. In any regard, the spout portion 110 may be positioned between the dispensing position 130 shown in FIG. 2A and the storage position 140 shown in FIG. 2B. In this regard, as described above, the spout portion 110 may allow any substance remaining on an exterior face 114 to drain back into the interior 18 of the container 10 through the orifice 112 when the spout portion 110 is in the storage position 140 as described above.

Figure 3B:
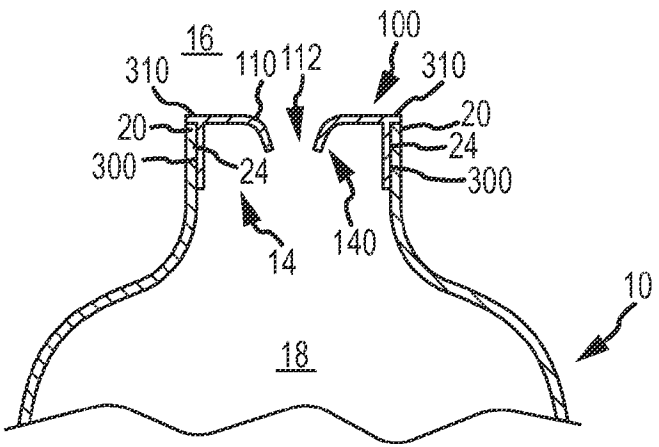
FIGS. 3A-3B depict cross sections of yet another embodiment of a lid having a spout portion in a dispensing position and a storage position, respectively.
Figure 3A:
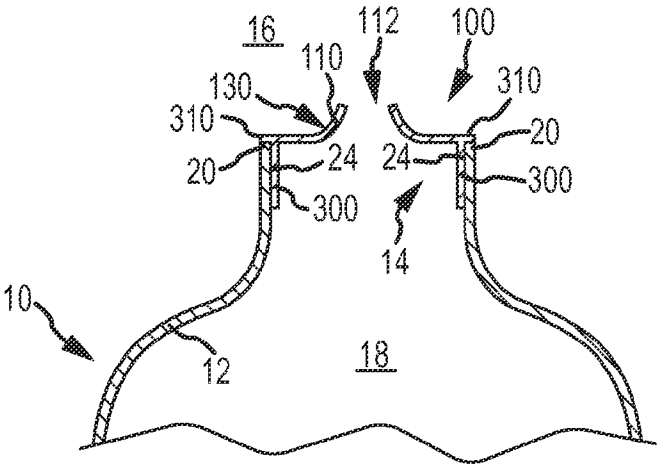

FIGS. 3A and 3B depict a lid 100 with another embodiment of an engagement portion 300. In FIG. 3A the spout portion 110 is in the dispensing position 130 and in FIG. 3B the spout portion 110 is in the storage position 140 as described above. The engagement portion 300 may engage an inner portion 24 of the sidewall 12 of the container 10 adjacent to the container opening 14. The engagement portion 300 may be engaged with the inner portion 24 of the sidewall 12 by any means known in the art, such as, for example, a threaded connection, an interference connection, a snap-fit engagement, or the like. As shown in FIGS. 3A and 3B, the spout portion 110 may extend from the engagement portion 300 adjacent to the terminal end portion 20 of the sidewall 12 defining the container opening 14. In this regard, a flange portion 310 may extend with respect to the terminal end portion 20 of the sidewall 12. For example, the flange portion 20 may define a stop in an embodiment where the lid 100 is press-fit into the opening 14 of the container 10.

Figure 4B:
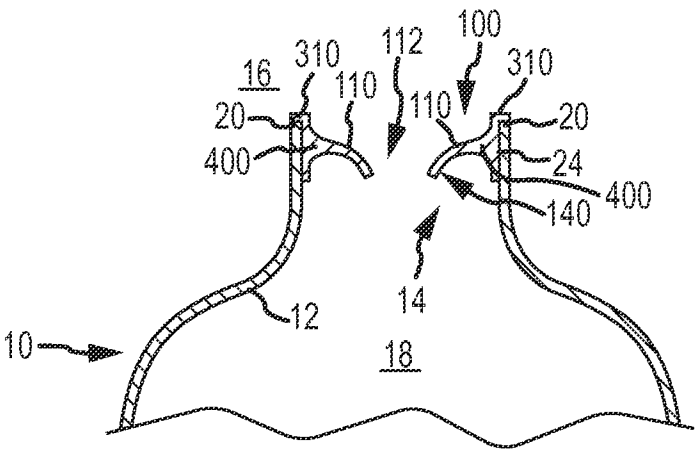
FIGS. 4A-4B depict cross sections of still another embodiment of a lid having a spout portion in a dispensing position and a storage position, respectively.
Figure 4A:
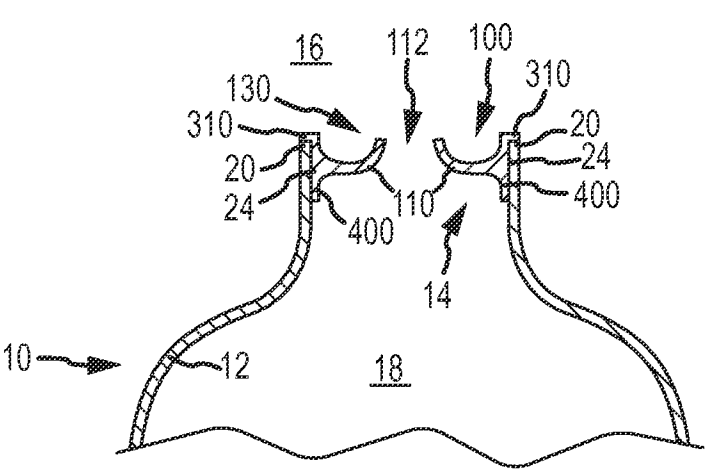

In another embodiment of an engagement member 400 as depicted in FIGS. 4A and 4B, the spout portion 110 may be offset from the terminal edge portion 20 of the container sidewall 12. In this regard, the spout portion 110 may be spaced apart from the terminal end portion 20 of the sidewall 12 in a direction toward the interior volume 14. In one embodiment, for example, the spout portion 110 may be spaced apart from the terminal end portion 20 of the sidewall 12 by a distance of about 3 mm. In another embodiment, the spout portion 110 may be spaced apart from the terminal end portion 20 of the sidewall 12 by a distance of not less than about 2 mm and not more than about 10 mm. Accordingly, the engagement portion 400 extending between the spout portion 110 and the flange portion 310 may define a cup-like space. It will be appreciated excess substance remaining in the cup-like space or along the exterior face 114 of the spout portion 110 may drain back into the interior 18 of the container 10 through the orifice 112.

Figure 5B:
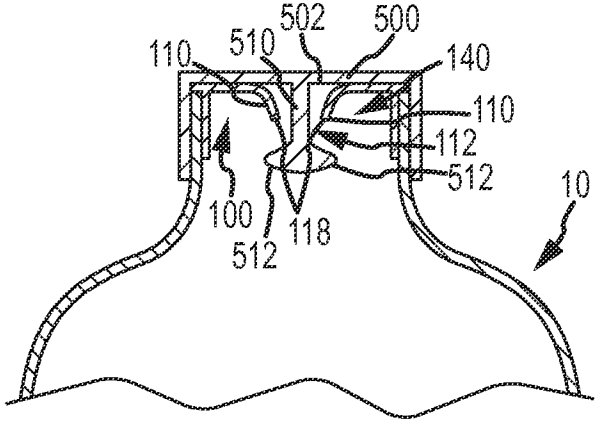
FIGS. 5A-5B depict cross sections of another embodiment of a lid having a spout portion in a dispensing position and a storage position, respectively, where the spout portion is positionable in the dispensing position and the storage position by a cap.
Figure 5A:
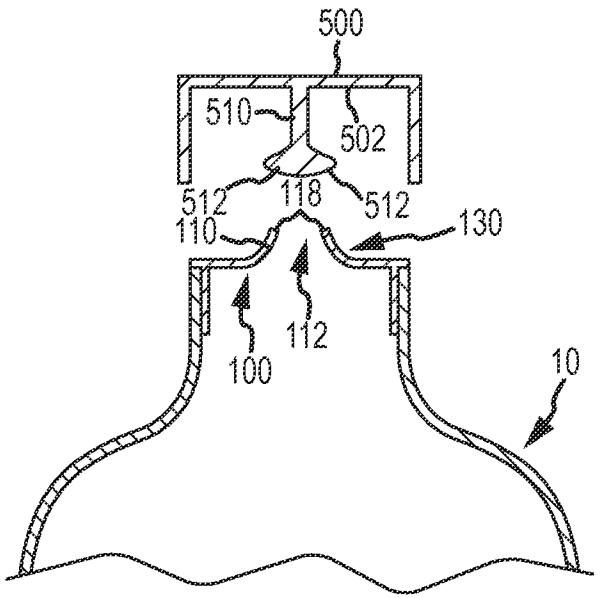

FIGS. 5A-5B show an embodiment of a lid 100 as may be used in conjunction with a closure cap 500 that allows a user to selectively position the spout portion 110 between the dispensing position 130 and the storage position 140. The cap 500 may include a projection 510 extending from an interior surface 502 of the cap 500. The cap 500 may be engageable with the container 10 so that the cap 500 sealingly engages the opening 14 of the container 10. When the cap 500 sealingly engages the opening 14, the projection 510 may extend through the orifice 112 of the spout portion 110. The projection 510 may include laterally extending protrusions 512 extending from the projection 510. The protrusions 512 may extend from the projection 510 a distance that corresponds generally to the size of the orifice 112. For example, the protrusions 512 may be sized slightly larger than the orifice 112. Accordingly, the protrusions 512 may engage the spout portion 110 at an edge 118 of the orifice 112 as the cap 500 is engaged with the container 10. The protrusions 512 may urge the spout portion 110 from the dispensing position 130 to the storage position 140 as shown in FIG. 5B.

For example, the spout portion 110 may be flexible about at least a portion of the orifice 112. The flexibility of the spout portion 110 may allow for the deflection of the spout portion 110 between the dispensing position 130 and the storage position 140 as discussed above. Furthermore, the flexible nature of the spout portion 110 may accommodate passage of the protrusions 512 of the projection 510 through the orifice 112. In one embodiment, the force required to move the spout portion 110 from the dispensing position 130 to the storage position 140 may be less than the force required to force the protrusions 512 through the flexible orifice 112. Thus, the protrusions 512 may act on the spout portion 110 to move the spout portion 110 to one of the dispensing position 130 and the storage position 140 (e.g., depending upon whether the cap 500 is being engaged with or disengaged from the container 10), and with continued application of force to the cap 500 the protrusions 512 may be passed through the orifice 112. In this regard, upon reversed application of force to the cap 500, the protrusions 512 may act in an opposite manner to move the spout between the other of the dispensing position 130 and the storage position 140.

Figure 6:
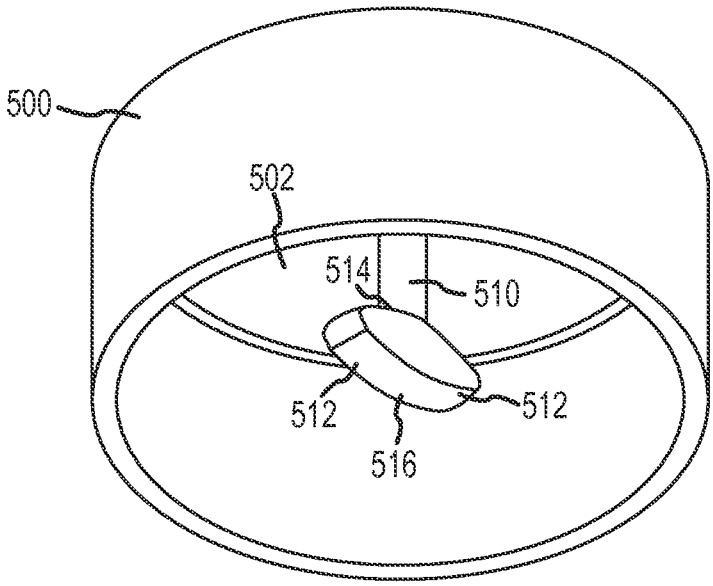
FIG. 6 is a perspective view of the lid of FIGS. 5A and 5B.

With further reference to FIG. 6, the protrusions 512 of the projection 510 may extend from the projection 510 in opposite directions (e.g., the protrusions 512 may define a "T" shape). The protrusions 512 may define an inclined upper surface 514 and an inclined lower surface 516. It will be appreciated that the inclined upper and lower surfaces 516 may assist in passing the protrusions 512 through the orifice 112 when removing or inserting the protrusions 512 through the orifice 112, respectively. It will be further understood that other profiles of projections and protrusions may be employed that engage the spout portion to push and/or pull the spout portion 110 between the storage position 140 and the dispensing position 130 when the cap 500 is secured to and removed from the container 10. Furthermore, the inclined upper surface 514 and/or inclined lower surface 516 may allow for any condiment remaining on the protrusions 512 to drip or otherwise fall back into the interior volume 118 of the container 10 to further prevent the lid 100 from becoming messy (e.g., caked with the condiment). In one embodiment, the projection 510 may be a solid portion of a material (e.g., the same material from which the cap 500 is constructed). In this regard, the projection 510 may be integrally formed with the cap 500. In another embodiment, the projection 510 may be a wire form having a shape described above including the protrusions 512 and upper and lower surface 514 and 516 shapes. That is, the projection 510 may be constructed of a different material than the cap 500. For example, the projection 510 may be over-molded with the cap 500.

Figure 7:
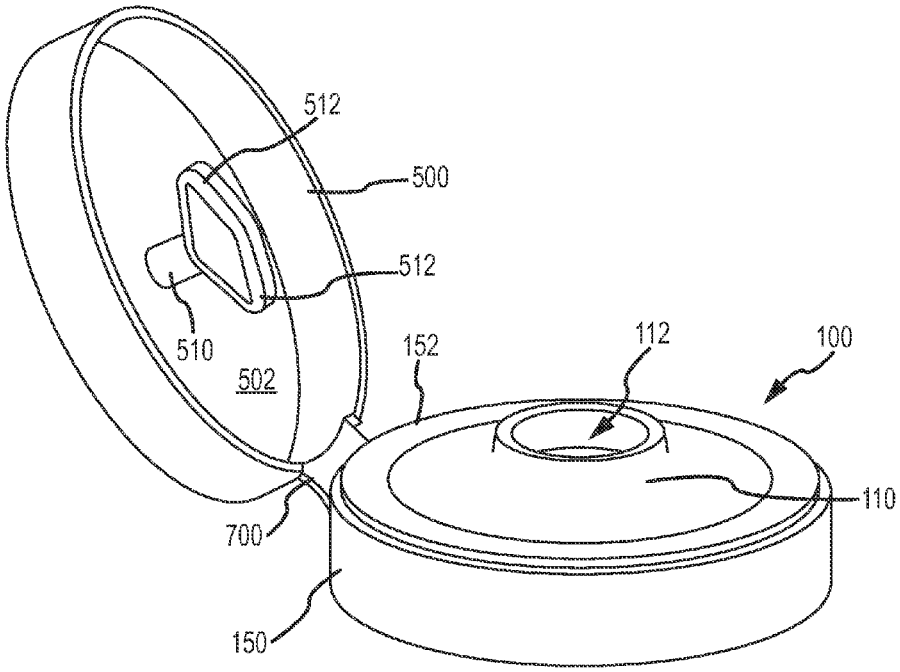
FIG. 7 is an alternative embodiment of a lid.

Furthermore, as shown in FIG. 7, the cap 500 may be attached to the lid 100. For example, the cap 500 may be engaged with the engagement portion 150 near a circumferential edge 152 thereof. For example, a hinge 700 (e.g., a living hinge made of the same material used to construct the engagement portion 150 on the cap 500) may be provided between the lid 100 and the cap 500. Thus, the cap 500 may be pivotally disposed with respect to the lid 100 such that the cap 500 may be moved between a closed position (e.g., to position the spout portion 110 in the storage position 140) and an open position (e.g., to position the spout portion 110 in a dispensing position 130).

Figure 8B:
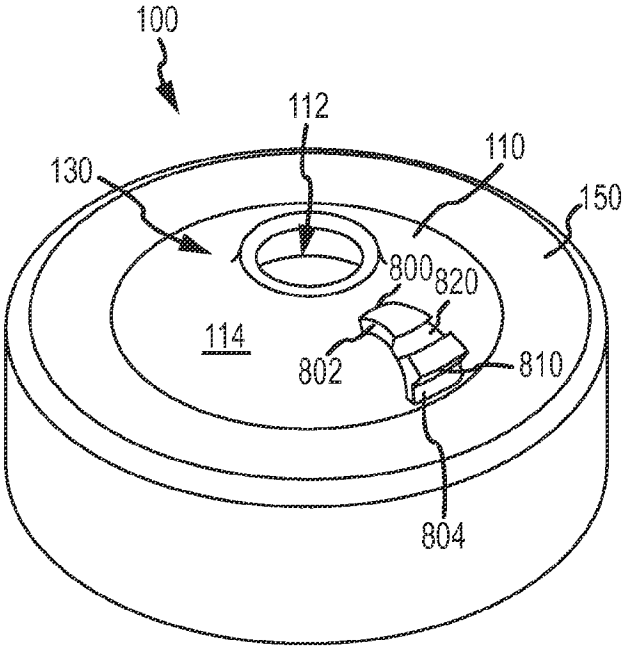
FIGS. 8A-8B are side and perspective views, respectively, of an embodiment of a lid in a dispensing position with a tab connected to the spout portion for positioning the spout portion between a dispensing position and a storage position.
Figure 8A:
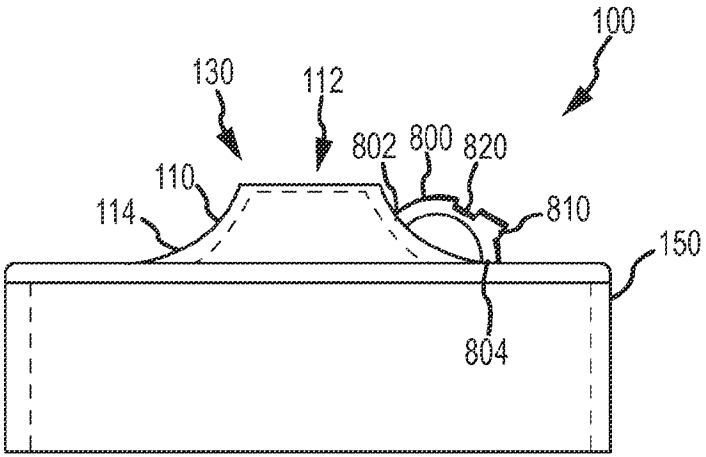
Figure 9B:
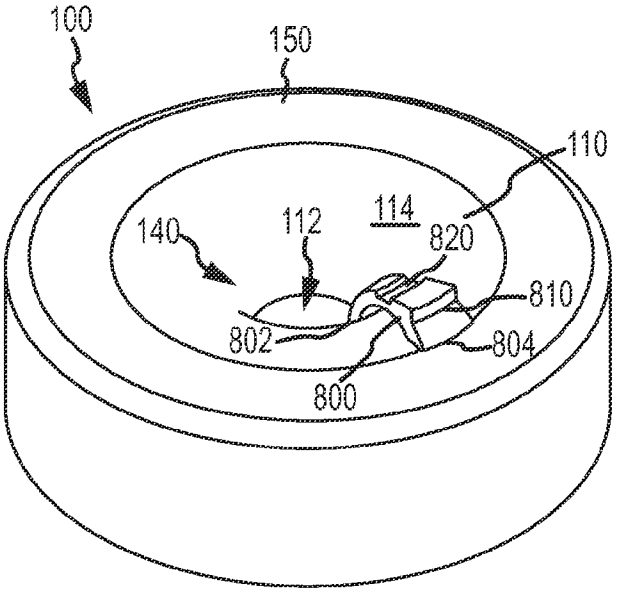
FIGS. 9A-9B depict side and perspective views, respectively, of the embodiment of FIGS. 8A-8B in a storage position.
Figure 9A:
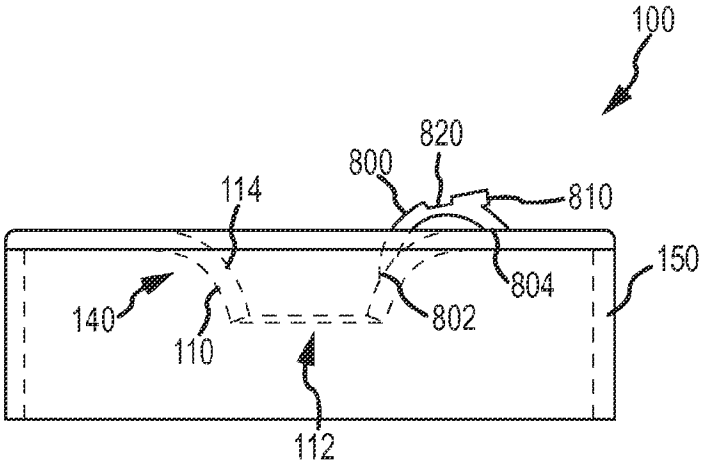

FIGS. 8A-9B depict another embodiment of a lid 100 with a tab 800 provided on the spout portion 110 for allowing a user to selectively position the spout portion 110 between the dispensing position 130 (as shown in FIGS. 8A and 8B) and the storage position 140 (as shown in FIGS. 9A and 9B). The tab 800 may be connected to the spout portion 110 at a first end 802 and a second end 804. The first end 802 may be connected to the spout portion 110 nearer the orifice 112 than the second end 804. For example, the tab 800 may be arranged radially with respect to the spout portion 110.

The tab 800 may provide one or more locations that may be easily manipulated by a user to move the spout portion 110 between the dispensing position 130 and the storage position 140. For example, the tab 800 may include a raised portion 810. The raised portion 810 may define a ridge along the tab 800. The raised portion 810 may provide a location along the tab 800 against which a user may exert a force. Upon application of force to the raised portion 810 of the tab 800, the tab 800 may pivot about the second end 804 (e.g., counter clockwise as shown in FIGS. 8A and 9A). In this regard, the first end 802 may exert a force on the spout portion 110 nearer the orifice 112 that tends to force the spout portion 110 toward the storage position 140.

Furthermore, the tab 800 may include a slot 820. The slot 820 may allow, for example, a user to engage the tab 800 with a fingernail. In turn, a force may be applied to the slot 820 in a direction generally opposite the force that may be applied to the raised portion 810. That is, the user may pull the spout portion 110 to the dispensing position 130 by applying a force to the slot 820 that tends to cause the tab 800 to pivot about the second end 804 in a clockwise direction as shown in FIGS. 8A and 8B). In this regard, the first end 802 attached nearer the orifice 112 than the second end 804 may pull the spout portion 110 to the dispensing position 130.

While the raised portion 810 and the slot 820 are used in the foregoing description to apply forces to the tab 800 to move the spout portion 110, it will be understood that other features may be provided on the tab 800 to facilitate application of force to the spout portion 110. For example, a user may grasp the tab 800 to push or pull the spout portion 110 between the dispensing position 130 and the storage position 140. Furthermore, other structures may be provided that allow a user to apply a force to the spout portion 110 to move the spout portion 110.

Figure 10A:
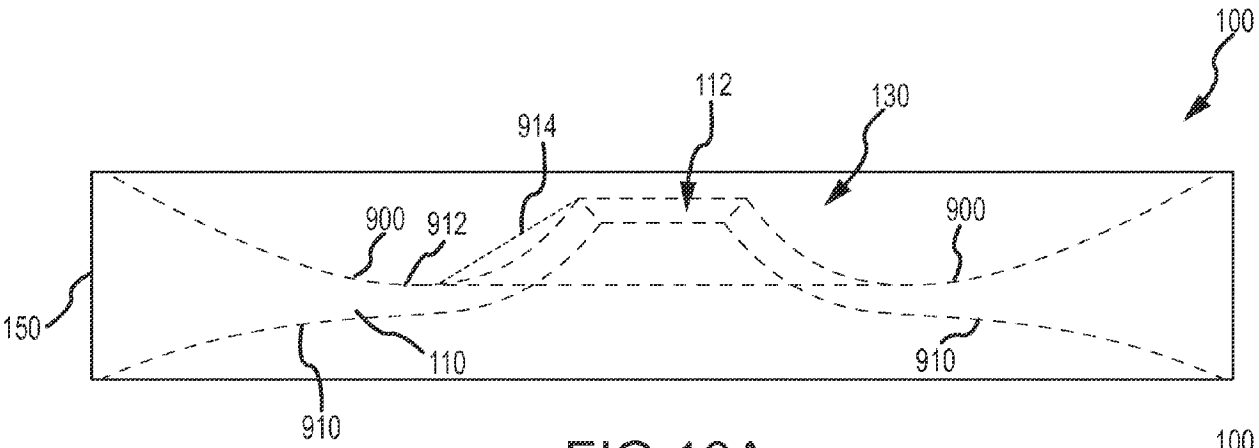
FIGS. 10A-10B depict cross sections of another embodiment of a lid having a contoured spout portion in a dispensing position and a storage position, respectively.
Figure 10B:
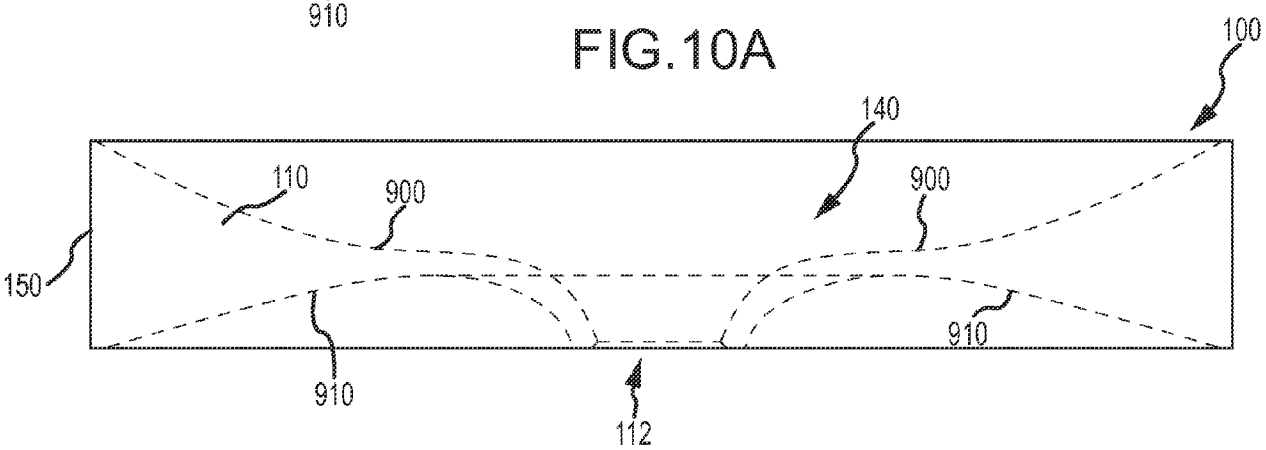

In another embodiment depicted in FIGS. 10A and 10B, a spout portion 110 may be provided that has a contoured exterior face 900. In this regard, the exterior face 900 of the spout portion 110 may be concave when in the dispensing position 130. When in the storage position 140, the exterior face 900 may include an inflected slope extending from the engagement portion 150 to the orifice 112. Accordingly, any condiment remaining on the exterior face 900 may be urged back through the orifice 112 when the spout portion 110 is disposed in the storage position 140. In this regard, the spout portion 110 may vary from a first thickness adjacent to the engagement portion 150 to a second thickness adjacent to the orifice 112. Furthermore, an interior face 110 may be provided that includes an inflected slope between the engagement portion 150 and the orifice 112 when in the storage position 140. In the embodiment depicted in FIGS. 10A and 10B, the angles a and b as described above with respect to FIG. 1A may be measured between an inflection point 912 of the spout portion 110 and the edge 118 of the orifice 112. That is, for example, as the exterior face 900 defines a concave surface when the spout portion 110 is in the dispensing position 130, the angle a of the spout portion 110 may be approximated by the angle between a line 914 extending from the lowest point (i.e., the inflection point 912) of the convex surface to the edge 118 of the orifice 112 and a plane corresponding to the upper surface 116 of the engagement portion 150.

In yet another embodiment, a spout portion may be provided such that the spout portion extends from the engagement portion a sufficient distance when in the dispensing position such that the orifice in the spout portion may be selectively closed (e.g., pinched together). This may be particularly advantageous to allow the contents of the container to be shaken without spillage from the orifice.

Additionally, while the foregoing embodiments discussed may have applicability in the context of a squeezable-type bottle, the embodiments disclosed herein may be provided for a non-squeeze container as well. For example, the spout portion 110 described in the foregoing embodiments may be used in an embodiment where the container 10 is not a squeezable-type bottle (e.g., having a substantially rigid sidewall made from plastic, glass, etc.). In one embodiment, a container may be provided with a vent to assist in dispensing condiment from the container. In this regard, even in the context of a non-squeezable container, the vent may allow condiment to flow through the orifice in the spout portion. The vent may be positioned on the container along the sidewall such that condiment does not flow through the vent when condiment is dispensed from the container or when the spout portion is disposed in the storage position and condiment flows back into the interior volume of the container. The vent may be indicated clearly such that the location of the vent is clearly recognizable to a user so as to properly orient the vent to allow for condiment to be dispensed from the container.

While the invention has been illustrated and described in detail in the drawings and foregoing description, such illustration and description is to be considered as exemplary and not restrictive in character. For example, certain embodiments described hereinabove may be combinable with other described embodiments and/or arranged in other ways (e.g., process elements may be performed in other sequences). Furthermore, as discussed briefly above, the containers, lids, and components disclosed herein may be used in various contexts and applications. In this regard, while certain specific dimensions are presented herein, larger, smaller, or different relative dimensions may be provided (e.g., dependent upon the context or application in which the lid is utilized). Accordingly, it should be understood that only the preferred embodiment and variants thereof have been shown and described and that all changes and modifications that come within the spirit of the invention are desired to be protected.

What is claimed is:

1. A lid for a container that is operable to contain a condiment in an interior volume thereof, the condiment being dispensable from the container, the lid comprising:

an engagement portion operatively engageable with the container adjacent to an opening of the container; and a spout portion extending from the engagement portion and covering at least a portion of the opening, the spout portion defining an orifice through which the condiment may be communicated and comprising an inner face and an outer face, the inner face being on a side of the spout portion nearer the inner volume than the outer face, wherein the spout portion is positionable between a dispensing position in which the condiment is dispensable through the orifice and a storage position in which the outer face defines a sloping surface extending toward the interior volume of the container and terminating at an edge of the orifice for directing any remaining substance on the exterior portion of the spout portion through the orifice and into the container;

wherein when in the storage position, the orifice remains open and the spout portion directs any of the condiment on an exterior portion of the spout portion through the orifice and into the container.

2. A lid according to claim 1, wherein the orifice is defined by the edge in concentric offset relation from the engagement portion.

3. A lid according to claim 1, wherein when in the storage position, the outer face is disposed relative to gravity to direct flow of any of the substance on an exterior portion of the spout portion through the orifice and into the container.

4. A lid according to claim 3, wherein at least a portion of the spout portion extends from a plane corresponding to an upper surface of the engagement portion by a distance of no less than about 2 mm and no more than about 15 mm when the spout portion in is the storage position.

5. A lid according to claim 4, wherein at least a portion of the spout portion is at a first angle relative to the plane corresponding to the upper surface of the engagement portion when the spout portion is in the storage position, wherein the first angle is no less than about 20 degrees and no more than about 80 degrees.

6. A lid according to claim 5, wherein the spout portion is selectively positionable between the dispensing position and engagement position by a user.

7. A lid according to claim 6, further comprising:

a cap selectively engageable with respect to the opening of the container to sealingly close the opening.

8. A lid according to claim 7, wherein the cap comprises a projection operatively engageable with the spout portion to dispose the spout portion between the dispensing position and the storage position, wherein the projection is correspondingly sized with the orifice to contactably engage the edge of the orifice to urge the spout portion to the storage position when the cap is attachably engaged with respect to the opening and to urge the spout portion to the dispensing position when the cap is removably disengaged with respect to the opening.

9. A lid according to claim 8, further comprising:

a tab connectedly engaged with the spout portion, the tab being mainpulateable to position the spout portion between the dispensing position and the storage position.

10. A lid according to claim 5, wherein the spout portion is biased to the storage position and is deflectable to the dispensing position when the substance is dispensed from the container, wherein the force of the substance acting on the spout portion during the dispensing positions the spout portion in the dispensing position.

11. A lid according to claim 1, wherein the orifice is no less than about 0.2 cm and no more than about 1.5 cm in diameter.

12. A lid according to claim 11, wherein the spout portion extends for a distance of no less than about 0.2 cm and no more than about 7.8 cm from the engagement portion to an edge defining the orifice.

13. A lid according to claim 12, wherein the thickness of the spout portion is constant.

14. A lid according to claim 13, wherein the thickness of the spout portion is no less than about 0.5 mm and no more than about 10 mm.

15. A container for retaining and dispensing a condiment, the container comprising:

a sidewall defining an interior volume for containing the condiment;

an opening between the interior volume and an exterior of the condiment;

a spout portion engaged with the opening and covering at least a portion of the opening, the spout portion having an inner face and outer face, the inner face being disposed nearer the interior volume than the outer face, wherein the spout portion defines an orifice through which the substance may be communicated;

wherein the spout portion is positionable between a dispensing position and a storage position, and when in said storage position, said outer face defines a sloping surface extending toward the interior volume of the container and terminating at an edge of the orifice to direct any condiment remaining on the outer face through the orifice, which is open when in the storage position, and into the interior volume.

16. A container according to claim 15, further comprising:

a cap for sealingly engaging the opening.

17. A container according to claim 16, wherein the cap includes a projection, at least a portion of which is disposable through the orifice to urge the spout portion between the dispensing position and the storage position.

18. A method for use with a container operable to dispense a substance, the method comprising:

positioning a spout portion adjacent to an opening of the container into a dispensing position, wherein the spout portion comprises an inner face and an outer face, the inner face being on a side of the spout portion nearer an inner volume of the container than the outer face;

dispensing the substance from the container through an orifice defined by the spout portion when the spout portion is in the dispensing position; and disposing the spout portion into a storage position wherein the outer face of the spout portion defines a sloping surface extending toward the interior volume of the container and terminating at an edge of the orifice; and directing any remaining substance on the outer face of the spout portion through the orifice, which is open in the storage position, and into the container when the spout portion is in the storage position.

* * * * *

UNITED STATES PATENT AND TRADEMARK OFFICE

CERTIFICATE OF CORRECTION

PATENT NO. : 8,757,442 B2
APPLICATION NO. : 13/444150
DATED : June 24, 2014
INVENTOR(S) : William Holden It is certified that error appears in the above-identified patent and that said Letters Patent is hereby corrected as shown below:

In the Specification:

Column 3, Line 35-36, delete “mainpulateable” and therefore insert --manipulateable--

Column 13, Claim 9, Line 22, delete “mainpulateable” and therefore insert --manipulateable--

Signed and Sealed this
Thirtieth Day of December, 2014

Michelle K. Lee

Michelle K. Lee
*Deputy Director of the United States Patent and Trademark Office*